US005107771A

United States Patent [19]

Kainz

[11] Patent Number: 5,107,771

[45] Date of Patent: Apr. 28, 1992

[54] CONNECTION OF SEVERAL CABLEWAY CARS

[75] Inventor: Johann Kainz, Vienna, Austria

[73] Assignee: Waagner-Biro Aktiengesellschaft, Austria

[21] Appl. No.: 664,889

[22] Filed: Mar. 5, 1991

[30] Foreign Application Priority Data

Mar. 8, 1990 [AT] Austria ..... 542/90

[51] Int. Cl.[5] ..... B61B 3/00

[52] U.S. Cl. ..... 105/149; 105/149.1; 104/112

[58] Field of Search ..... 104/112, 174, 173.1, 104/193; 213/7, 75 R, 149; 198/475.1, 797, 680; 105/149.1, 149, 150, 151, 152, 156

[56] References Cited

U.S. PATENT DOCUMENTS 4,280,411 7/1981 Katayose et al. ..... 104/112

OTHER PUBLICATIONS

"Internat. Seilbahnrundschau", Umbau Pendelbahn Gerlosstein, p. 32, Mar. 1989.

*Primary Examiner*—Robert J. Oberleitner
*Assistant Examiner*—Kevin D. Rutherford
*Attorney, Agent, or Firm*—Steinberg & Raskin

[57] ABSTRACT

The invention relates to a shock-absorbing angle-bent coupling rod disposed for the mechanical connection of cableway cars. Preferably, the coupling rod has a bend of approximately 90 degrees and includes at least one shock-absorber and spring mechanism. In one preferred embodiment, the side of the bend in the coupling rod includes a friction vibration absorber. The vibration absorption between the individual cableway cars provided by the present invention allows such vibration to be distributed throughout the entire cableway system so that the cableway speed and traveling comfort can be increased without compromising safety.

8 Claims, 2 Drawing Sheets

CONNECTION OF SEVERAL CABLEWAY CARS

FIELD OF THE INVENTION

The present invention relates to the connection of adjacent cars of a suspension cableway by means of a coupling rod bent at an approximately 90 degree angle and disposed on the bottom of the cableway car approximately in the center of the car below the point of engagement of the suspension tackle.

BACKGROUND OF THE INVENTION

Railroad cars are commonly connected to each other via a coupling rod. Since small, substantially constant adjustments in the alignment of a railroad track are made upward or downward with regard to a vertical direction, the play of the coupling rod in the individual coupling organs of the train suffices to control the stresses between the individual railroad cars. The same applies when the train is driven around a curve. Consequently, neither tensile or compression forces are exerted through the coupling rod onto the following car, and instead these forces may be dampened through the dead weight of the railroad cars and transferred to the abutment between the cars.

While this may be true for railroad cars, the conditions are entirely different with respect to cableway cars, in particular with respect to suspension cableways, where the rails are laid out practically in a chain line. In such systems, two adjacent suspension cableway cars connected to each other through a coupling rod require a greater motion play than normal railroad cars. Added to this is the fact that the vibration stress from the cable as well as stress from other sources (such as wind) must not be increased through the use of a coupling rod. In addition, the problem of potential overload must be addressed in the development stage of a cableway system (similar to a railroad train). This is especially true with cableway cars due to their extremely light construction. Thus, a rigid coupling rod connecting two cableway cars is unsatisfactory.

In addition to the above-mentioned problems, sudden changes of direction of the suspension cable on or at supports may cause cableway cars to experience lift-up phenomena between the individual cars. Such lift-up phenomena increase the danger of derailing and/or causes significant operation disturbances.

From the "Internat. Seilbahnrundschau" No. 3/1989, page 32, a bent coupling rod having a hinged support for frequency increase is known. The bent coupling rod opposes an increase of the cableway speed due to the lack of an automatic vibration absorption.

SUMMARY OF THE INVENTION

In view of the above, it is therefore an object of the present invention to confront the above-mentioned difficulties and others and to dampen the vibrations between adjacent cableway cars of a cableway system.

The present invention builds on the example of a uniformly vibrating rectangle and is characterized therein that the coupling rod has at least one shock-absorbing and elastic member known per se and is affixed with it on the cableway car.

More particularly, the present invention relates to a suspension cableway apparatus, comprising a plurality of cableway cars suspended from a track disposed above the cableway cars. The cableway cars are connected to the track via a suspension tackle located above each cableway car, and a coupling rod connects adjacent cableway cars, the coupling rod having a bend of approximately 90 degrees and including at least one shock-absorbing means and at least one elastic member.

More particularly, the present invention relates to a suspension cableway apparatus, comprising a first and second cableway car each having a top and a bottom, a track disposed above the first and second cableway cars, the first and second cableway cars connected to the track via a first and second suspension tackle, respectively. A coupling rod is connected to the first and second cableway cars, the coupling rod having a first and connected to the bottom of the first cableway car and a and second end connected to the bottom of the second cableway cars. The first and second ends of the coupling rod are substantially centered on the bottom of the first and second cableway cars below the first and second suspension tackles, respectively. The coupling rod has a bend of approximately 90 degrees and includes at least one shock-absorbing means and at least one elastic member.

In one preferred embodiment, the shock-absorbing means and elastic member are arranged such that the coupling rod is elastically displaceable and shock-absorbed on the first cableway car or the second cableway car, or both.

In another preferred embodiment, the coupling rod comprises telescoping sections and the shock-absorbing means and the elastic member are disposed in proximity to the first end or the second end, or both.

In another preferred embodiment, the coupling rod includes an articulation located at the bend in the coupling rod. The articulation includes a friction vibration damper and springs for maintaining the distance between the first and second cableway cars.

The present invention also relates to a coupling rod for connecting adjacent cableway cars in a suspension cableway apparatus, the coupling rod including a first end having means for attachment to a first cableway car and an opposite end having means for attachment to an adjacent cableway car, the coupling rod further comprising a main body portion having a bend of approximately 90 degrees, the coupling rod having at least one shock-absorbing means and at least one elastic member. In one preferred embodiment, the coupling rod comprises telescoping sections and the shock-absorbing means and elastic member are disposed in proximity to the first end or the second end, or both. In another preferred embodiment, the site of the bend in the coupling rod includes an articulation having a friction damper and springs for maintaining the distance between adjacent cableway cars.

The vibration absorption between the individual cableway cars provided by the present invention allows such vibration to be distributed throughout the entire cableway system so that the cableway speed and traveling comfort can be increased without compromising safety.

DETAILED DESCRIPTION

Figure 1:
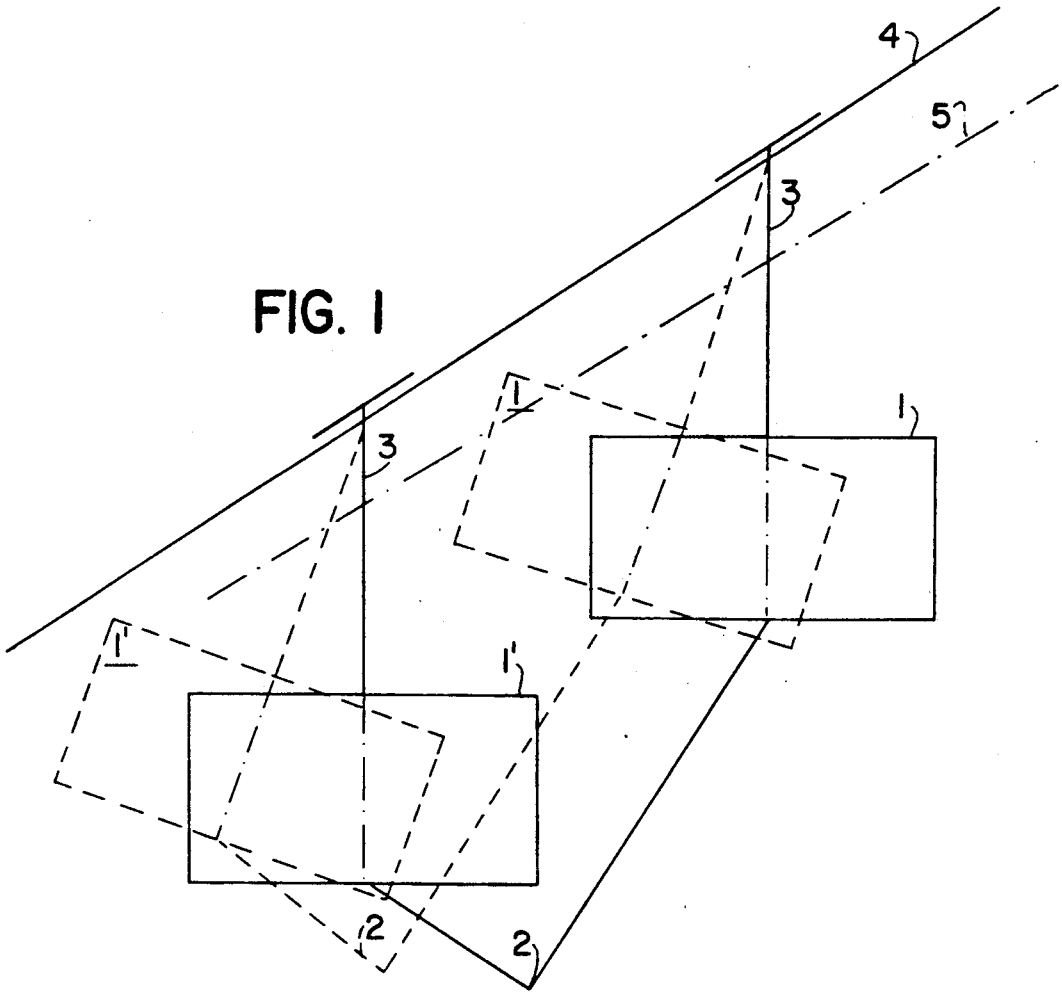
FIG. 1 is a side view showing the arrangement of a coupling rod in accordance with the present invention located between two cabins of a suspension cableway.

FIG. 1 shows a suspension cableway wherein two suspension cableway cars (1, 1') are connected by coupling rods (2, 2'), respectively. The individual cableway cars are connected through a suspension tackle 3 with the driving unit which is supported slidably on a track 4, which may be for example a suspension cable or rail. Traction cable 5 is disposed approximately parallel and somewhat below track 4. Traction cable 5 can guide the cableway cars, e.g., from a valley station (not shown) into a mountain station (not shown). The two cableway cars are connected to each other via coupling rod 2, or through a spring structure. As can be seen in FIG. 1, the coupling rod 2 has a main body portion which is bent at a substantially 90 degree angle.

Figure 2:
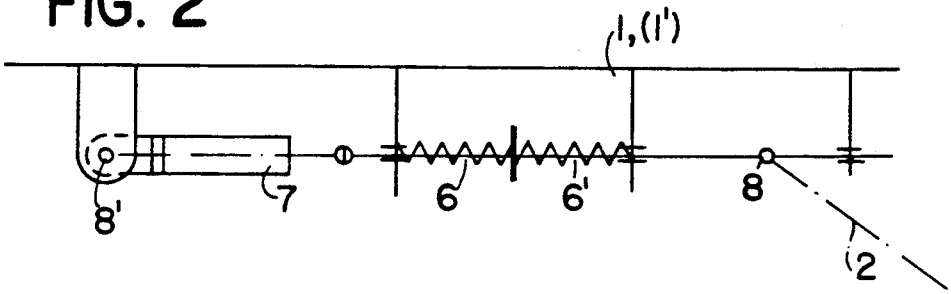
FIGS. 2–4 side views showing the connection of the cable rod to the individual suspension cable way cars.

FIG. 2 depicts one preferred embodiment of the present invention which is designed to ensure that the coupling points at which the coupling rod 2 engages the cableway cars cabins have essentially a constant interval. For reasons of vibration technology, it is desirable that both cableway cars 1, 1' vibrate uniformly such that the effect of a shock from one car to the other is dampened through shock absorbers. This complex task is accomplished in the embodiment depicted in FIG. 2 by separating the attachment point 8' of the coupling rod 2 on the cableway car from the articulation point 8 of the coupling rod 2 such that a dampened spring-loaded motion is possible between points 8 and 8'. The springs 6 and/or 6' maintain a neutral position and the shock absorber 7 prevents a build-up of the motion.

Figure 3:
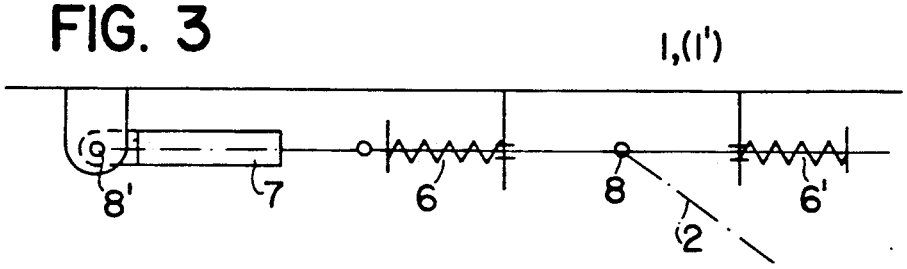

FIG. 3 shows an embodiment of the present invention which differs from that shown in FIG. 2 by a constructional chain so that the two sets of springs 6, 6' can be disposed separately and simultaneously the support of the connection structure with cableway car 1 or 1' respectively is simplified.

Figure 4:
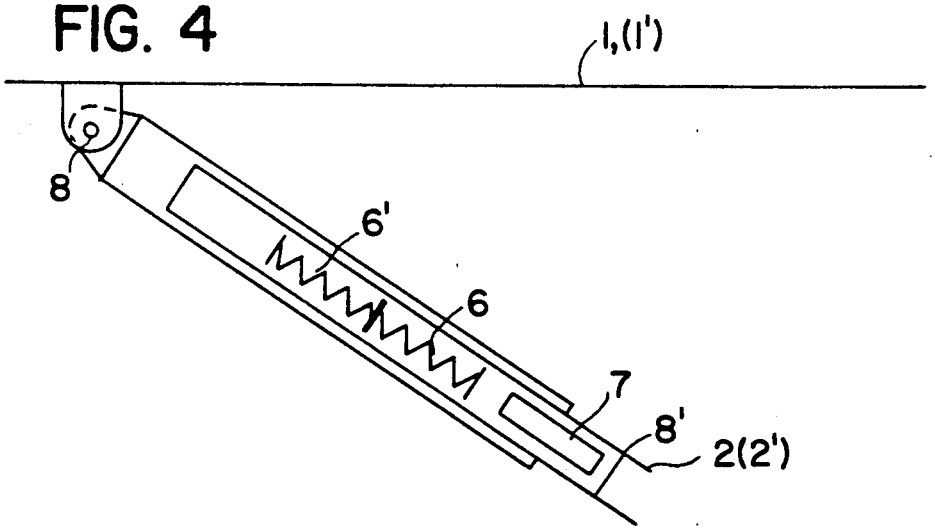

FIG. 4 discloses the structure of a telescoping coupling rod 2 (2') which permits a simple connection at the connection point 8 of the cableway car 1 (1') respectively, wherein the range of spring action is disposed so as to be protected by a pipe structure. The shock-absorbing coupling rod 2 (2') is connected via a joint block (connection point 8) with two longitudinally movable guidance rods wherein the guidance rods are kept in a neutral position in the forceless state by means of springs 6 and 6' so that the force is transmitted from the coupling rod 2 (2') to the guidance rods. The guidance rods shift due to an exerted force and the springs 6 and 6' are reset depending on the direction of the force. The shock-absorber 7 absorbs the resulting energy.

FIG. 4 discloses another embodiment of the present invention wherein the coupling rod 2 is a telescoping coupling rod. Telescoping coupling rod 2 permits a simple connection at the connection point 8 of the cableway car 1 or 1' respectively, wherein the range of spring action is disposed so as to be protected by a pipe structure. As shown in FIG. 4, the coupling rod 2 is carried through an external pipe, in which is also dispensed a rod on which springs 6 or 6' respectively, and/or in the extension shock-absorber 7 is accommodated in an inner pipe. The shock-absorber 7 is connected in the connection point 8' with the inner pipe of the coupling rod proper 2 or 2' respectively. The inner pipe is slidably supported in the outer pipe. The inner rod assumes the supporting connection and also the absorption of the shock forces through the shock-absorber 7.

The implementations of FIGS. 2–4 can be disposed on both cableway cars as well as on only one of the two cableway cars. Such modifications are hereby deemed to be within the scope of the appended claims.

Figure 5:
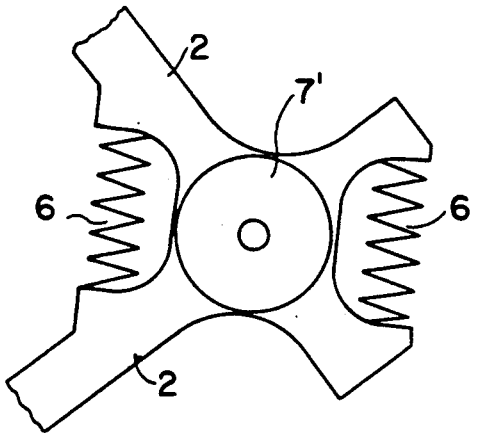
FIG. 5 is a plan view of a movable connection between two coupling rods extending at different angles with respect to each other.

FIG. 5 depicts another embodiment of the present invention wherein a movable connection is located between two coupling rods which extend at different angles with respect to each other. In this embodiment, the coupling rod 2 is freely movable. A friction damper 7' and two articulated sets of springs 6 are included as shown. The friction damper 7, and springs 6 maintain a constant interval between the coupling points at which the coupling rod 2 engages the cabins (not shown in this Figure). The articulated implementation of the coupling rod 2 at the bend as shown in FIG. 5 controls the range of spring action and thus the motion of the cableway cars. The embodiment depicted in FIG. 5 includes a friction damper 7', which acts in similar fashion to the shock-absorber 7 depicted in FIG. 4.

The apparatus of the present invention makes it possible to connect large cableway cars with each other and also allows for short track lengths in station buildings so that the construction measures are relatively narrowly limited.

An important advantage of the invention is that through the relatively inexpensive apparatus herein described, the passenger frequency may be doubled.

The examples of the invention detailed above are not meant to limit the scope of the present invention. Many modifications of the examples detailed herein would be obvious to one skilled in the art, and are deemed to be within the scope of the appended claims.

What is claimed is:

1. A suspension cableway apparatus, comprising a first and second cableway car each having a top and a bottom, track disposed above said first and said second cableway cars, said first and second cableway cars connected to said track via a first and second suspension tackle, respectively, and a coupling rod connecting said first and second cableway cars, said coupling rod having a first end connected to the bottom of said first cableway car and a second end connected to the bottom of said second cableway car, said first and second ends being substantially centered below said first and second suspension tackles, respectively, said coupling rod having a bend of approximately 90 degrees and including at least one shock-absorbing means and at least one elastic member.

2. The apparatus of claim 1, wherein said elastic member comprises a spring.

3. The apparatus of claim 1, wherein said shock absorbing means and said elastic member are arranged such that said coupling rod is elastically displaceable and shock-absorbed on at least one of said cableway cars.

4. The apparatus of claim 1, wherein said coupling rod comprises telescoping sections and said shock-absorbing means and said elastic member are disposed in proximity to at least one of said ends of said coupling rod.

5. The apparatus of claim 1, wherein said coupling rod includes an articulation located at said bend, said articulation having a friction damper and springs for maintaining the distance between said first and second cableway cars.

6. In a suspension cable having a plurality of cableway cars suspended from a track running above said cableway cars and each of said cableway cars are suspended from said track via a suspension tackle, the improvement comprising connecting adjacent cableway cars with a coupling rod bent at an approximately 90 degree angle, said coupling rod being disposed below said cableway cars and having a first end connected to the bottom of a first cableway car and an opposite end connected to the bottom of an adjacent cableway car, the connection of said first end and said opposite end to said first and adjacent cableway cars being substantially directly below the point of engagement of said cableway cars with said suspension tackles, said coupling rod including at least one shock-absorbing means and at least one elastic member.

7. A coupling rod for connecting adjacent cableway cars in a suspension cableway apparatus, said coupling rod including a first end having means for attachment to a first cableway car and an opposite end having means for attachment to an adjacent cableway car, said coupling rod further comprising a main body portion having a bend of approximately 90 degrees, said coupling rod having at least one shock-absorbing means and at least one elastic member.

8. The coupling rod of claim 7, wherein said coupling rod comprises telescoping sections and said shock-absorbing means and elastic member are disposed in proximity to at least one of said ends of said coupling rod.

* * * * *